US007752971B2

(12) United States Patent
Loehr

(10) Patent No.: US 7,752,971 B2
(45) Date of Patent: Jul. 13, 2010

(54) ADAPTER FOR SHAPED CHARGE CASING

(75) Inventor: John D. Loehr, Needville, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/175,004

(22) Filed: Jul. 17, 2008

(65) Prior Publication Data

US 2010/0011945 A1 Jan. 21, 2010

(51) Int. Cl.
*F42B 1/02* (2006.01)
*E21B 7/00* (2006.01)
*E21B 29/02* (2006.01)

(52) U.S. Cl. ..... 102/306; 175/4.6; 166/63

(58) Field of Classification Search ..... 102/306, 102/309, 310, 311; 175/4.6; 166/63
See application file for complete search history.

(56) References Cited

U.S. PATENT DOCUMENTS

| | | | | | |
|---|---|---|---|---|---|
| 2,750,885 | A * | 6/1956 | Schlumberger | 175/4.6 |
| 2,947,251 | A * | 8/1960 | Jilly | 175/4.6 |
| 2,947,252 | A * | 8/1960 | Lindsay, Jr. | 102/310 |
| 3,094,930 | A * | 6/1963 | Blair | 175/4.6 |
| 3,415,321 | A * | 12/1968 | Venghiattis | 166/297 |
| 3,444,810 | A * | 5/1969 | Hakala | 102/310 |
| 3,468,386 | A * | 9/1969 | Johnson | 175/4.6 |
| 3,565,188 | A * | 2/1971 | Hakala | 175/4.6 |
| 3,589,453 | A * | 6/1971 | Venghiattis | 175/4.6 |
| RE28,061 | E * | 7/1974 | Shore | 175/4.6 |
| 4,140,188 | A * | 2/1979 | Vann | 175/4.51 |
| 4,273,047 | A * | 6/1981 | Rommer | 102/310 |
| 4,326,462 | A | 4/1982 | Garcia et al. | |
| 4,523,649 | A * | 6/1985 | Stout | 175/4.51 |
| 4,875,413 | A * | 10/1989 | Christopher et al. | 102/307 |
| 4,889,183 | A | 12/1989 | Sommers et al. | |
| 5,007,486 | A * | 4/1991 | Ricles | 175/4.6 |
| 5,648,635 | A | 7/1997 | Lussier et al. | |
| 5,750,917 | A * | 5/1998 | Seckler et al. | 102/476 |
| 5,952,603 | A * | 9/1999 | Parrott | 102/312 |
| 6,419,044 | B1 * | 7/2002 | Tite et al. | 181/116 |
| 6,530,326 | B1 | 3/2003 | Wendt, Jr. et al. | |
| 7,165,614 | B1 * | 1/2007 | Bond | 166/297 |
| 7,347,279 | B2 | 3/2008 | Li et al. | |
| 2005/0173118 | A1 * | 8/2005 | Li et al. | 166/297 |
| 2007/0053785 | A1 | 3/2007 | Hetz et al. | |

OTHER PUBLICATIONS

U.S. Appl. No. 12/027,765, filed Feb. 2, 2008, Titled "Perforating System with Shaped Charge Case Having a Modified Boss".

* cited by examiner

*Primary Examiner*—Bret Hayes
(74) *Attorney, Agent, or Firm*—Bracewell & Giuliani LLP

(57) ABSTRACT

A shaped charge for use with a perforating gun having an adapter that can couple the shaped charge with perforating gun systems of more than one size. An interference fit can couple the adapter to the open end of a shaped charge. The adapter includes a base section having an outer diameter exceeding the shaped charge outer diameter. The adapter larger diameter can be coupled to perforating gun systems formed to receive shaped charges whose outer diameters exceed the outer diameter of the shaped charge coupled to the adapter. Thus the adapter can couple a shaped charge to a perforating gun that might otherwise have fittings too large to accommodate the shaped charge.

15 Claims, 6 Drawing Sheets

ADAPTER FOR SHAPED CHARGE CASING

BACKGROUND

1. Field of Invention

The invention relates generally to the field of oil and gas production. More specifically, the present invention relates to an adapter for a shaped charge used in perforating. Yet more specifically, the present invention relates to an adapter for a perforating shaped charge that couples a shaped charge in a perforating gun or tube configured for a different sized shaped charged.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

One typical example of a perforating system 4 is shown in FIG. 1. As shown, the perforating system 4 comprises one or more perforating guns 6 strung together to form a perforating gun string 3, these strings of guns 6 can sometimes surpass a thousand feet of perforating length. Connector subs 18 provide connectivity between each adjacent gun 6 of the string 3. Many gun systems, especially those comprised of long strings of individual guns, are conveyed via a conveyance means 5. Examples of conveyances means 5 for deploying or suspending the gun systems within a wellbore include tubing, wireline or slickline.

Included with the perforating gun 6 are shaped charges 8 that typically include a housing, a liner, and a quantity of high explosive inserted between the liner and the housing. When the high explosive is detonated, quickly expanding explosive gases are formed whose force collapses the liner and ejects it from one end of the charge 8 at very high velocity in a pattern called a "jet" 12. The jet 12 perforates the casing and the cement and creates a perforation 10 that extends into the surrounding formation 2. The resulting perforation 10 provides fluid communication between the formation 2 and the inside of the wellbore 1.

A side partial sectional view of a portion of a perforating gun 6 is illustrated in FIG. 2. The perforating gun 6 includes an elongated cylindrical gun body 14 housing a gun tube 16 therein. A shaped charge 8 is mounted in the gun tube 16 generally orthogonal to the tube axis $A_X$. The gun body 14 includes an optional recess 19 aligned with the shaped charge opening 11 to reduce gun body 14 material in the jet 12 path. A lower opening 15 through a portion of the gun body 16 receives the base 9 or closed end of the shaped charge 8. A corresponding upper opening 17 receives the shaped charge 8 open end 11 therethrough; the openings (15, 17) are generally aligned with the shaped charge axis $A_{SC}$. Shaped charge 8 detonation typically occurs by sending a detonation signal through or along the conveyance means 5 from the surface 13. A firing head 7 receives the signal that responds by igniting a detonation cord 20 that passes through the gun string 3 and connects to each shaped charge 8. Igniting the detonation cord 20 creates a pressure wave that contacts each shaped charge 8 and activates an initiator 21 that in turn detonates the high explosive in the shaped charge 8.

Typically the upper opening 17 in the gun tube 16 is sized to match the shaped charge 8 dimensions. Since shaped charges 8 may be produced in multiple standard sizes, gun tubes 16 having correspondingly sized openings (15, 17) are required for these shaped charges 8. In some instances, operational delays may occur if a properly dimensioned gun tube 16 is not available to accommodate certain sized shaped charges.

SUMMARY OF INVENTION

The present disclosure concerns a perforating system having an adapter used with shaped charges that allows shaped charges to be used in perforating systems configured for larger shaped charges. In one example the present disclosure includes a perforating system for use in a subterranean wellbore that includes a tubular shaped charge holder, an aperture formed through the tubular, where the aperture dimensions are defined by a first size. Also included is an adapter coupled to the shaped charge holder at the aperture, the adapter dimensions defined by a second size. A shaped charge is coupled in the adapter, the shaped charge having a shaped charge case with a closed end and an open end. The adapter is coupled to the shaped charge proximate to the charge case open end, the shaped charge case dimensions defined by a third size.

BRIEF DESCRIPTION OF DRAWINGS

Some of the features and benefits of the present invention having been stated, others will become apparent as the description proceeds when taken in conjunction with the accompanying drawings, in which.

Figure 1:
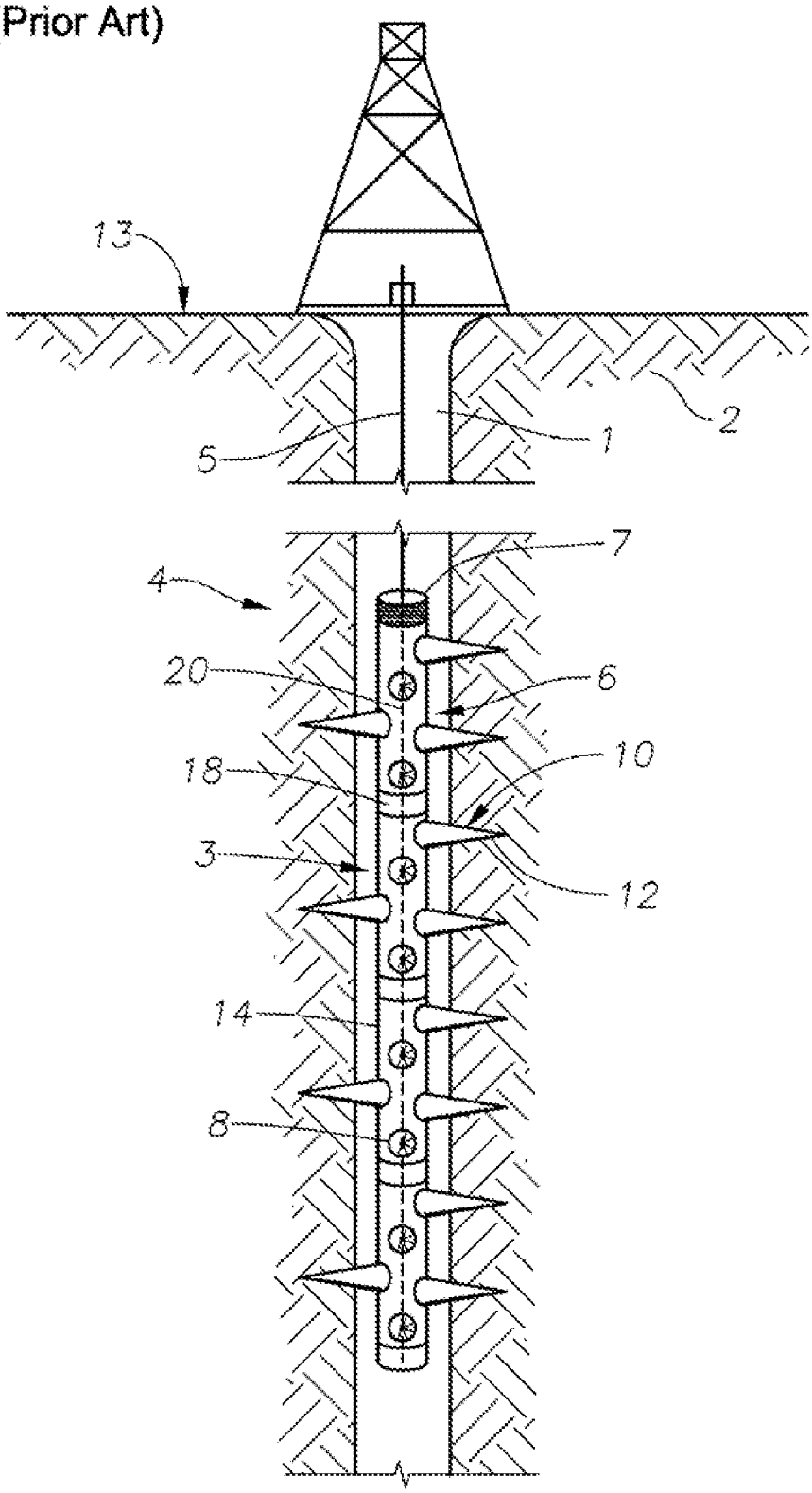
Fig. 1 (Prior Art)
FIG. 1 is a partial cutaway side view of a perforating system.
Figure 2:
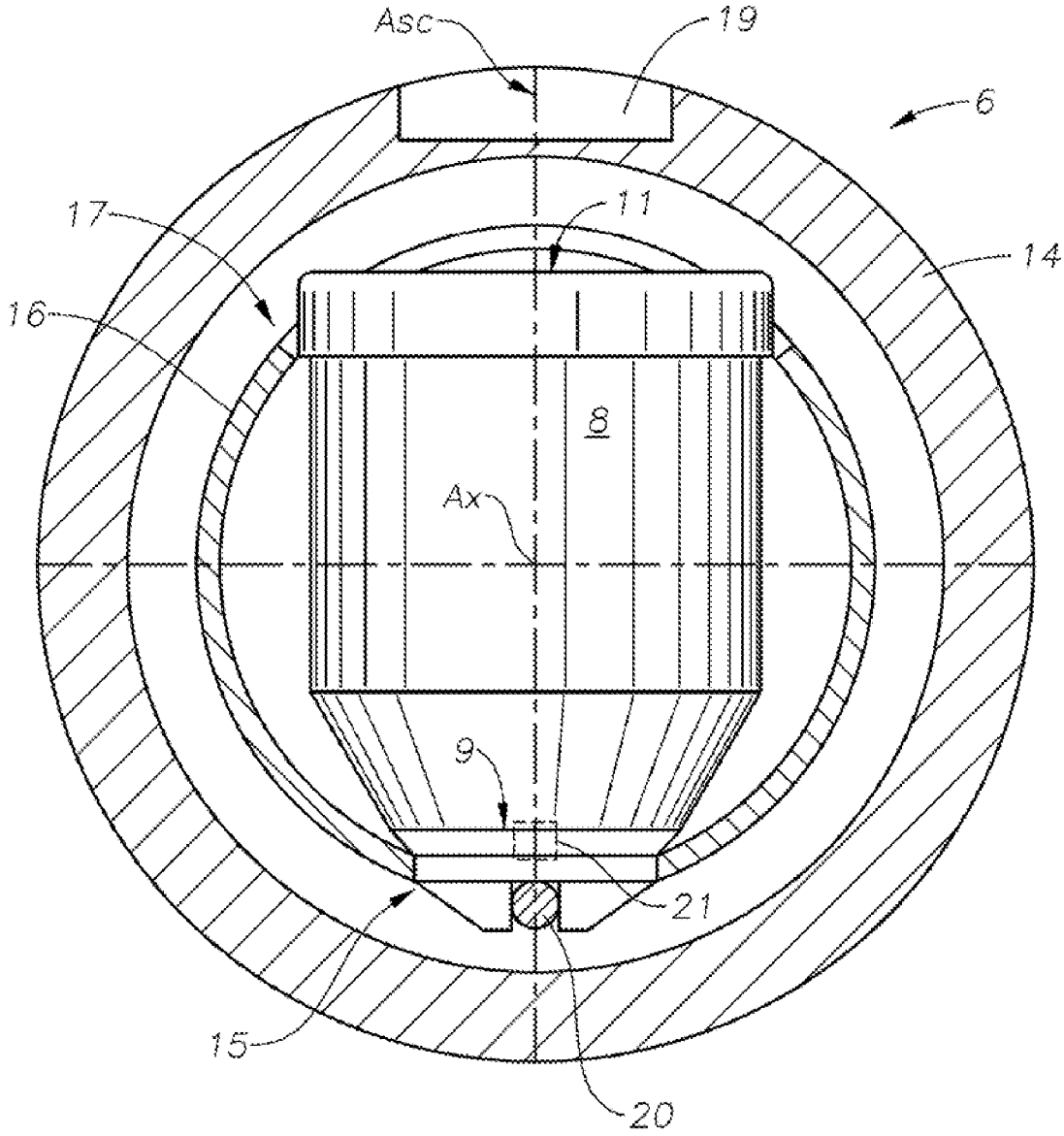
Fig. 2 (Prior Art)
FIG. 2 illustrates a partial cutaway of a portion of a perforating gun.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be through and complete, and will fully convey the scope of the invention to those skilled in the art. Like numbers refer to like elements throughout.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

The present disclosure concerns an adapter used with a shaped charge, where the shaped charged is used in subterranean perforating for oil and gas hydrocarbon production. One example of a shaped charge 30 with an adapter 38 is provided in a perspective partial sectional view in FIG. 3. As shown, the shaped charge 30 includes a shaped charge case 32 having a base 37 on one end and upwardly extending walls. The walls terminate in an opening 33 at the end of the case 32 opposite the base 37. A frusto-conical liner 34 is inserted within the case 32 with its conical end disposed proximate the base 37. High explosive 36 is disposed between the liner 34 and the inner circumference of the case 32.

Figure 3:
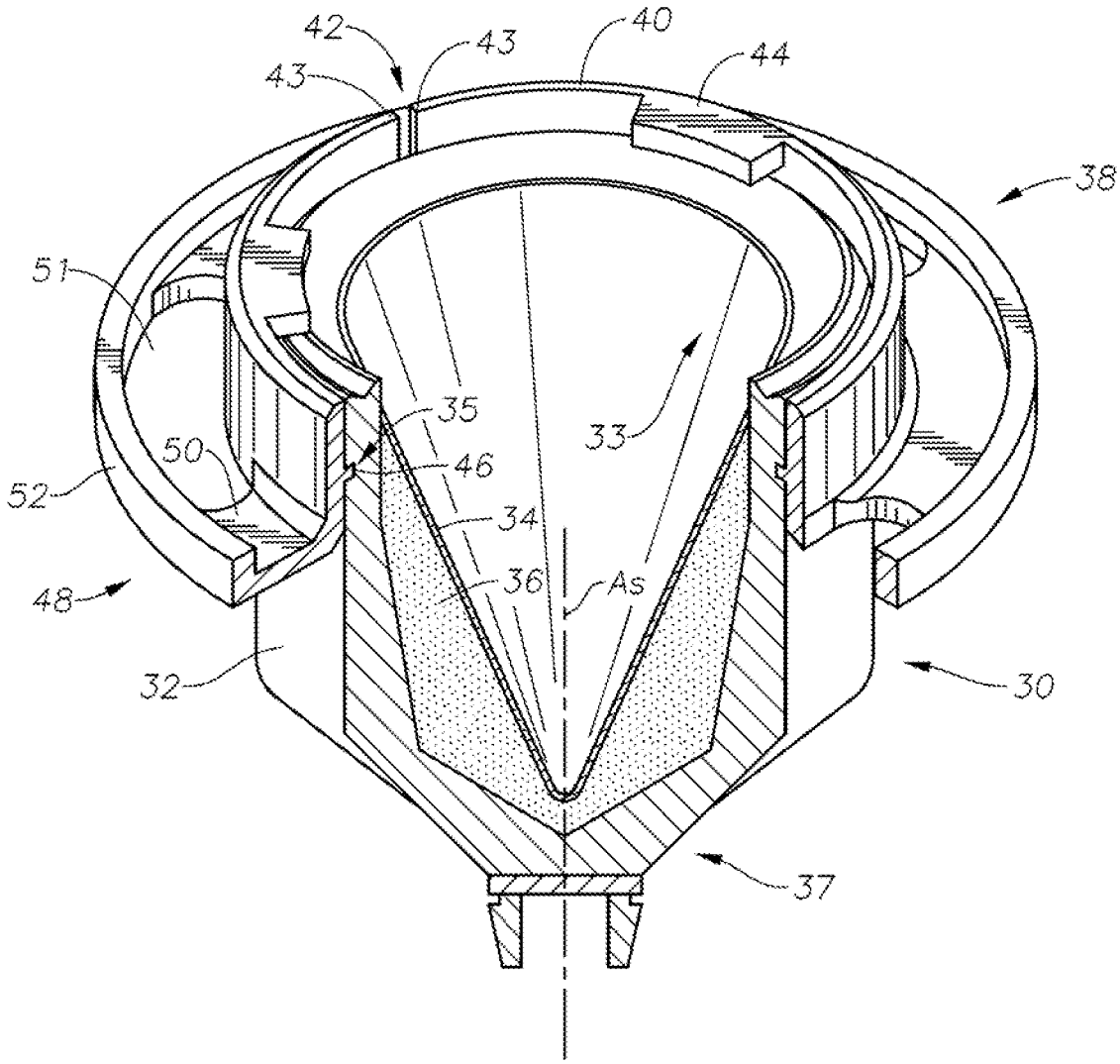
FIG. 3 is a perspective partial sectional view of a shaped charge having an adapter.

The adapter 38 is coupled to the charge casing 32 on its outer circumference and proximate the opening 33. In the embodiment of FIG. 3, the adapter 38 includes an annular collar 40 coupled to the charge case 32 by an interference fit. The adapter 38 includes a split section 42 extending axially through the adapter 38 at a location along the adapter 38 circumference. The adapter 38 circumference is thus expandable by increasing the split section 42 length. Forming the adapter 38 from an elastic material, such as steel, enhances interference coupling by internal stresses in the material urging together the adapter ends 43 adjacent the split section 42. The collar 40 has an elongate cross-section with the elongate length substantially parallel to the shaped charge 30 axis $A_S$.

An optional tab 44 is affixed to the inner circumference of the collar 40 extending radially inward towards the axis $A_S$ of the shaped charge 30. The tab 44 may provide a stopping point for the shaped charge 30 upper terminal end and to align the shaped charge 30 within a shaped charge holder. Also formed on the inner circumference of the collar 40 is a raised profile 46 shown extending substantially along the entire inner circumference of the collar 40. A corresponding groove 35 on the charge case 32 outer circumference registers with the inwardly protruding profile 46. The profile 46 and groove 35 can be used as a latching means between the adapter 38 and shaped charge 30 as well as a means for aligning the adapter 38 on the shaped charge 30.

The adapter 38 of FIG. 3 also includes a base member 48 extending radially outward from the collar 40. As will be discussed in more detail below, the base member 48 outer diameter enables coupling between the shaped charge 30 and a shaped charge holder. Radially extending outward from the collar 40 outer surface is an annular disk-like connector ring 50 that terminates on its outer periphery at an annular outer ring 52. The outer ring 52 has an elongate cross-section, with its elongate length generally perpendicular with the axis $A_S$ of the shaped charge 30. The connector ring 50 includes apertures 51 formed therethrough at various locations along the connector ring 50 circumference. Optionally, however, the base 48 may include other configurations, such as a single member having a uniform cross-section around the entire circumference.

Figure 4:
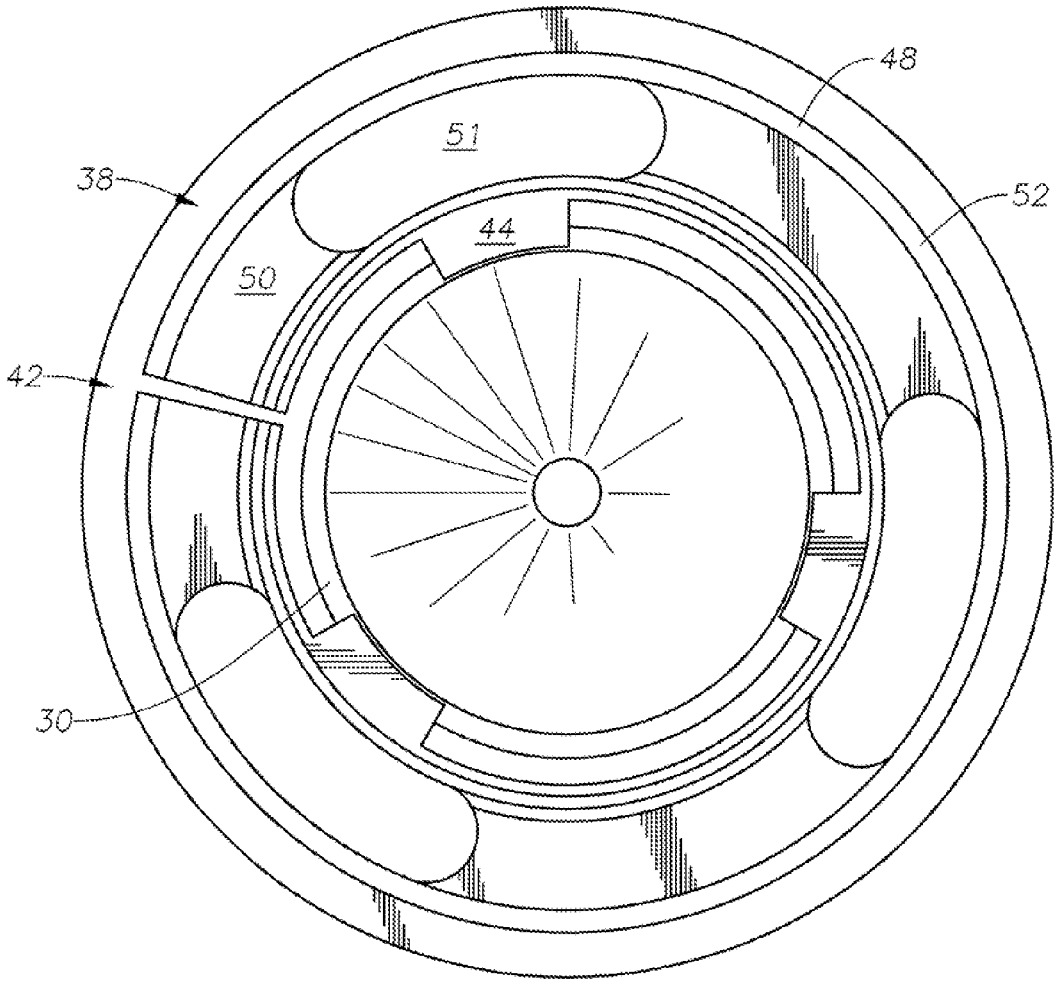
FIG. 4 is an overhead view of the shaped charge and adapter of FIG. 3.

An overhead view of the combination shaped charge 30 with adapter 38 is provided in FIG. 4. In this embodiment, the terminal ends of the tabs 44 are shown generally aligned with the shaped charge case 32 inner circumference thereby disposed above the entire width of the charge case 32 walls. Alternatively, the tabs 44 may extend over a portion of the charge case 32 wall width. The adapter 38 substantially circumscribes the shaped charge 30 outer circumference. Other embodiments of the adapter 38 exist where the adapter 38 circumscribes about 50% or more of the shaped charge 30 outer circumference.

A side partial sectional view of a shaped charge 30 with an adapter 38 is illustrated disposed within a perforating system. In this embodiment, the shaped charge 30 is combined with a shaped charge holder that is illustrated as a gun tube 56. Optionally, the shaped charge holder could include a gun body. The gun tube 56 includes an opening 54 through a portion of its section on which the adapter 38 is coupled. For the purposes of discussion herein, the coupling comprises the adapter 38 outer diameter exceeding the opening 54 diameter thereby allowing the coupling 38 to rest over the shaped charge holder and retain the shaped charge 30 within the shaped charge holder 56. As is known, shaped charges are available in multiple standard sizes, thus most shaped charge holders include openings or apertures configured to match those standard sizes. Use of the adapter 38 herein enables a shaped charge 30 having a particular size to be utilized within shaped charge holders 56 wherein the corresponding openings 54 may be one or more standard sizes greater than the standard size of the particular shaped charge 30. Accordingly, a shaped charge having the adapter 38 described herein and equivalents thereof can be installed into more than one gun system or kit, where the gun systems include openings 54 of more than one size. Additionally, use of the adapter 38 also enables a single gun body 58 having the same size openings 54 to have installed individual shaped charges 30 of more than one size. For example, an embodiment exists where a gun body 58 has single size openings 54, but includes some deep penetrating shaped charges and some gravel pack shaped charges, where the charges smaller than the openings 54 are adapted for installation with the adapter 38.

Figure 5:
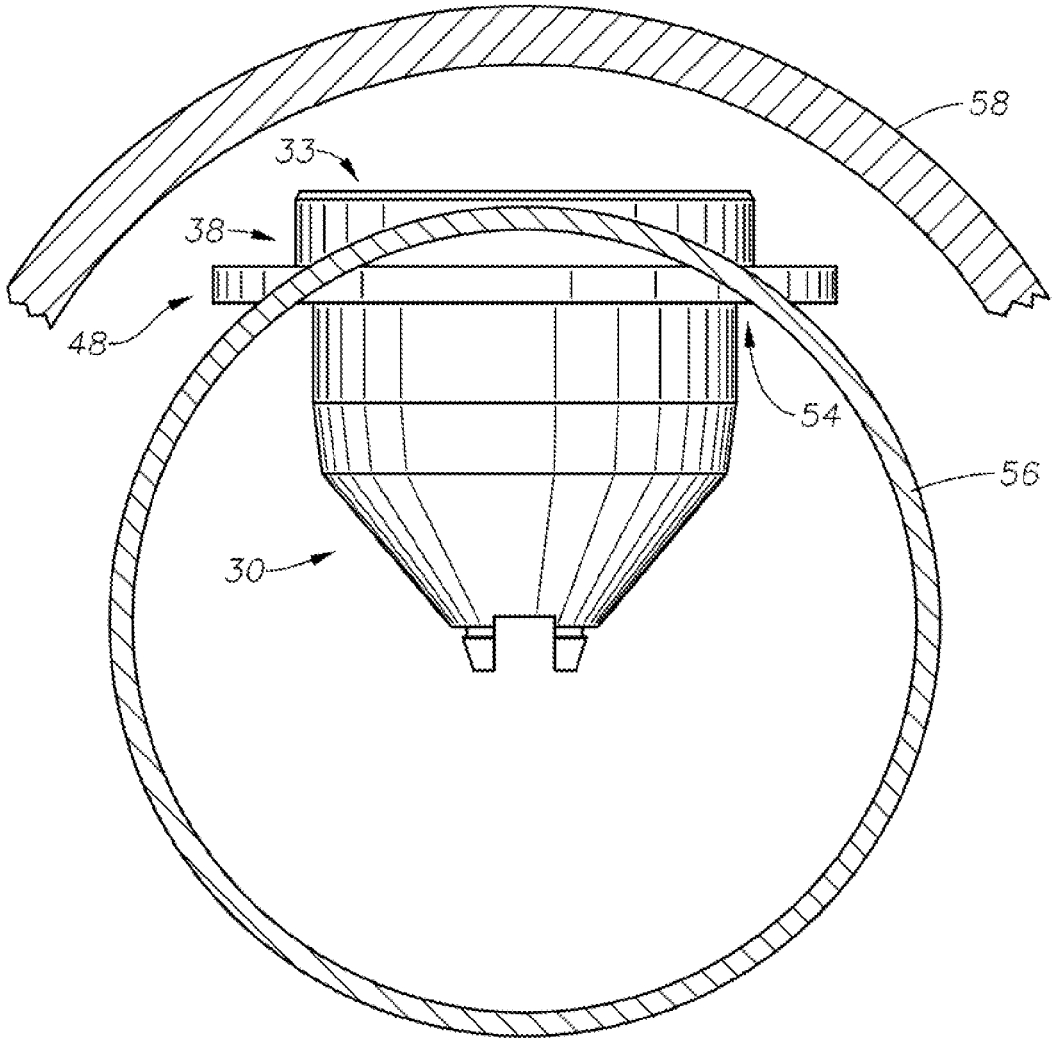
FIG. 5 is a side view of a shaped charge with an adapter in a perforating gun body.

As illustrated in FIG. 5, the gun body 58 is disposed above the opening 33 of the shaped charge 30. Thus, in the example shown, the dimensions of the opening 54 can be defined as having a first size, the dimensions of the adapter 38 can be defined as having a second size, and the dimensions of the shaped charge 30 can be defined as having a third size. The first size sufficiently exceeds the third size, such that the smaller shaped charge 30 passes through the opening 54. However, because the adapter 38 has dimensions of a second size, wherein the second size exceeds the dimensions of the first size, the adapter 38 is shown coupled onto the shaped charge holder 56. Additionally, due to the press fit or interference fit of the adapter 38 with the shaped charge 30, the shaped charge 30 is affixed with the adapter, and also coupled with the shaped charge holder 56 by virtue of its connection with the adapter 38.

Figure 6:
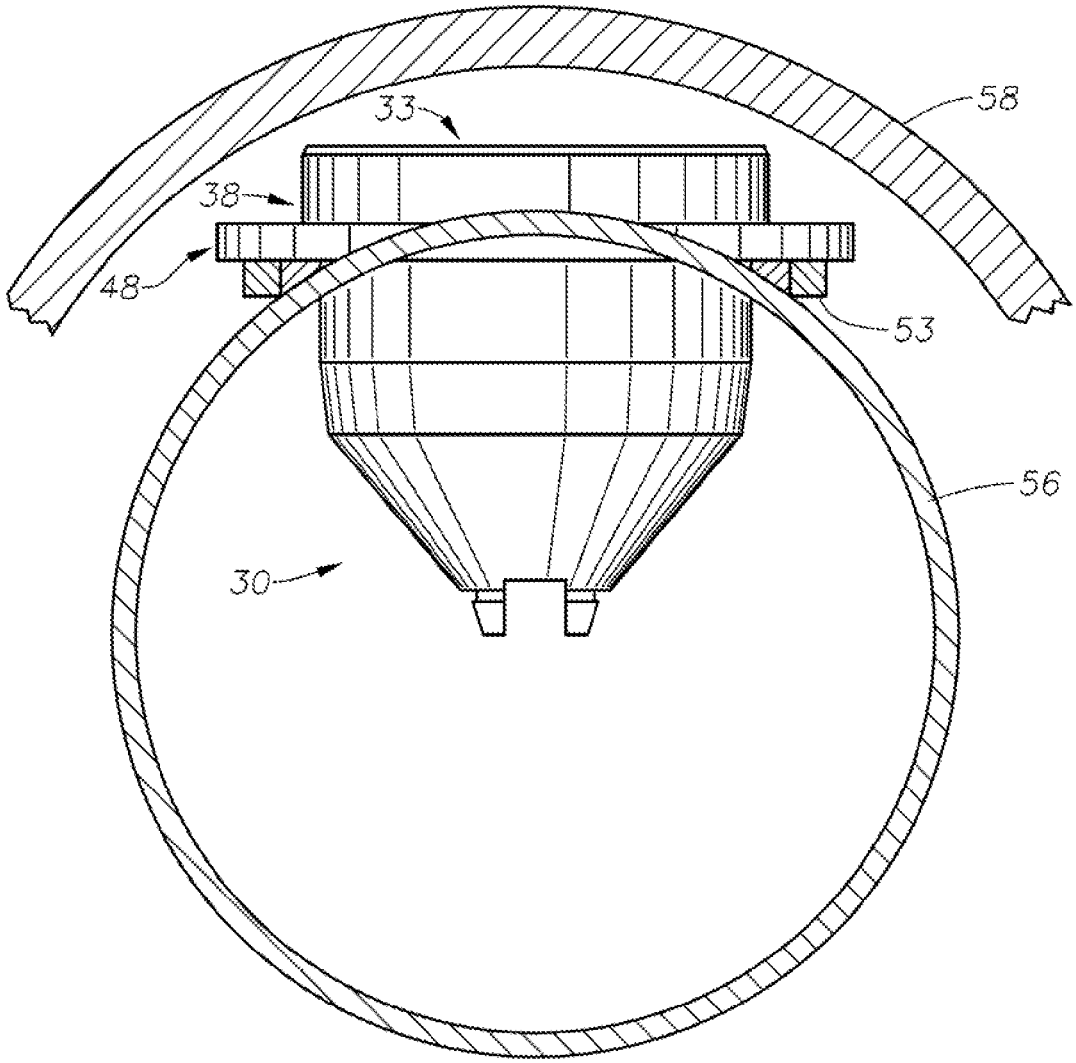
FIG. 6 is a side view of a shaped charge with an adapter in a perforating gun body including a spacer shim.

With reference now to FIG. 6, an example of a shim spacer 53 and adapter 38 is illustrated in a side partial sectional view. The shim spacer 53, as shown in cross section, is an annular member disposed between the base member 48 lower surface and the gun tube 56 outer surface. Installing the shim spacer 53 positions the shaped charge 30 closer to the gun body 58 and can enhance shaped charge performance by adjusting jet 12 formation and extension. Jet 12 formation and extension can be a function of the jet 12 focal point, which is extended into the formation 2 by repositioning the shaped charge 30 as illustrated. Based on the formation encountered, adjusting the jet 12 formation can extend perforations 10 and increase hydrocarbon production from the formation 2. Those skilled in the art have sufficient capabilities to adjust jet 12 formation by sizing and/or positioning the spacer shim 53. The spacer shim 53 can be integral with the adapter 38, or can be a separate component. The shim spacer 53 is not limited to an annular shape, but can have other configurations. Additionally, the shim spacer 53 can also be comprised of two or more elements spaced around the shaped charge 30. Moreover, the present disclosure includes embodiments where a shim spacer 53 is installed with shaped charges that do not include an adapter, but where the shaped charges with a shim spacer 53 are disposed within the same size shaped charge holder.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the adapter 38 can also affix shaped charges within carrier strips and other charge holders. These and other similar modifications will readily suggest themselves to those skilled in the art, and are intended to be encompassed within the spirit of the present invention disclosed herein and the scope of the appended claims.

What is claimed is:

1. A perforating system for use in a subterranean wellbore comprising:

a shaped charge holder;

an opening having a diameter and formed through the shaped charge holder;

an annular adapter in contact with the shaped charge holder outer surface, and the annular adapter having an outer diameter greater than the diameter of the opening, an annular member defined along the inner diameter of the annular adapter; and a shaped charge within the shaped charge holder and having a shaped charge case extending through the opening, the shaped charge case having an open end, a closed end, and a groove proximate the open end on the outer circumference of the shaped charge case coupled to a profile provided along the inner circumference of the annular member.

2. The perforating system of claim 1, wherein the opening is at least one standard size greater than the size of the shaped charge.

3. The perforating system of claim 1, wherein the size of the shaped charge coupled with the adapter ranges between at least two standard sizes.

4. The perforating system of claim 1, further comprising a tab extending radially inward from the annular member inner circumference.

5. The perforating system of claim 1, further comprising a split section formed axially along a section of the adapter.

6. The perforating system of claim 1, further comprising additional shaped charges that range between at least two standard sizes, multiple additional apertures formed through the shaped charge holder that range between at least two standard sizes, and multiple additional adapters having the same size as the adapter of claim 1.

7. The perforating system of claim 1, wherein the closed end is unsupported within the shaped charge holder.

8. The perforating system of claim 1, further comprising a spacer shim disposed between the adapter and the shaped charge holder.

9. The perforating system of claim 1, wherein the shaped charge holder is an annular tubular member.

10. A method of forming a shaped charge system, the system comprising a shaped charge holder, a shaped charge, a groove circumscribing the outer periphery of the shaped charge, and an opening in the shaped charge holder, the method comprising:

providing an annular adapter having an outer diameter greater than the diameter of the opening, an inner diameter less than the diameter of the opening, and a profile along the inner diameter configured for attachment to the groove in the shaped charge;

coupling the shaped charge into the annular adapter by registering the profile with the groove;

inserting the shaped charge with coupled adapter into the opening;

landing the adapter onto the shaped charge holder so that the adapter circumscribes at least a portion of the opening thereby installing the shaped charge within the shaped charge holder; and installing the shaped charge holder within a gun body and connecting the shaped charge to receive an initiation signal.

11. The method of claim 10 further comprising, disposing the gun body within a wellbore, sending an initiation signal, and detonating the shaped charge.

12. The method of claim 10 further comprising placing a spacer shim between the adapter and the shaped charge holder outer surface thereby elevating the shaped charge within the opening.

13. The method of claim 10, wherein the shaped charge holder includes an additional opening, the additional opening having the second size, the method further comprising installing a shaped charge within the additional opening and inserting the shaped charge holder within a gun body, thereby forming a gun body having different sized shaped charges.

14. A perforating system for use in a subterranean wellbore comprising:

an annular shaped charge holder;

an opening formed through a sidewall of the shaped charge holder;

a shaped charge comprising a case with a closed end, an open end, a closed end opposite the open end, a groove in the case proximate the open end, and walls extending between the open end and the closed end;

an annular adapter having an inner circumference fitted with a profile that is coupled to the groove of the shaped charge proximate the open end and adjacent the shaped charge holder so that the walls are circumscribed by the opening and the closed end is in the shaped charge holder; and a shim spacer disposed between the adapter and the outer surface of the shaped charge holder proximate the opening.

15. The perforating system of claim 14 wherein the adapter and the opening each have an outer periphery and wherein the outer periphery of the adapter circumscribes the outer periphery of the opening.

* * * * *